US008307974B2

(12) United States Patent
Saunders et al.

(10) Patent No.: US 8,307,974 B2
(45) Date of Patent: Nov. 13, 2012

(54) LOAD BEAM UNIT REPLACEABLE INSERTS FOR DRY COAL EXTRUSION PUMPS

(75) Inventors: Timothy Saunders, Rancho Palos Verdes, CA (US); John D. Brady, Northridge, CA (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 13/010,904

(22) Filed: Jan. 21, 2011

(65) Prior Publication Data

US 2012/0186946 A1 Jul. 26, 2012

(51) Int. Cl.
*B65G 15/00* (2006.01)

(52) U.S. Cl. ..... 198/626.1; 198/838; 415/5

(58) Field of Classification Search .... 198/626.1–626.6, 198/497, 643, 838; 415/5
See application file for complete search history.

(56) References Cited

U.S. PATENT DOCUMENTS

| | | | | |
|---|---|---|---|---|
| 516,702 | A | 3/1894 | Franklin | |
| 1,011,589 | A | 12/1911 | Curtis | |
| 1,136,578 | A | 4/1915 | Ayres | |
| 1,758,397 | A | 5/1930 | Harber | |
| 1,824,756 | A | 9/1931 | Weiser, Jr. | |
| 1,971,553 | A | 8/1934 | Fisk | |
| 2,628,705 | A | 2/1953 | Kline et al. | |
| 2,959,364 | A * | 11/1960 | Anderson et al. | 241/200 |
| 2,999,581 | A * | 9/1961 | Baugh | 100/151 |
| 3,034,638 | A | 5/1962 | Franz | |
| 3,245,517 | A | 4/1966 | Ward | |
| 3,511,360 | A | 5/1970 | Jagiel | |
| 3,691,942 | A * | 9/1972 | Wagley | 100/151 |
| 3,844,398 | A | 10/1974 | Pinat | |
| 3,856,658 | A | 12/1974 | Wolk et al. | |
| 4,069,911 | A | 1/1978 | Ray | |
| 4,191,500 | A | 3/1980 | Oberg et al. | |
| 4,197,092 | A | 4/1980 | Bretz | |
| 4,206,610 | A | 6/1980 | Santhanam | |
| 4,218,222 | A | 8/1980 | Nolan, Jr. et al. | |
| 4,351,637 | A * | 9/1982 | Dixon | 474/148 |
| 4,356,078 | A | 10/1982 | Heavin et al. | |
| 4,377,356 | A | 3/1983 | Santhanam | |
| 4,391,561 | A | 7/1983 | Smith et al. | |
| 4,433,947 | A | 2/1984 | Kratzer et al. | |
| 4,488,838 | A | 12/1984 | Herud | |
| 4,611,646 | A | 9/1986 | Wassmer et al. | |
| 4,664,253 | A * | 5/1987 | Fahrion | 198/851 |
| 4,721,420 | A | 1/1988 | Santhanam et al. | |

(Continued)

FOREIGN PATENT DOCUMENTS

| | | |
|---|---|---|
| EP | 0930254 | 7/1999 |

(Continued)

OTHER PUBLICATIONS

EP Search Report for EP12151728 dated Jun. 29, 2012.

*Primary Examiner* — Mark A Deuble
(74) *Attorney, Agent, or Firm* — Carlson, Gaskey & Olds PC

(57) ABSTRACT

A track assembly for a particulate material extrusion pump according to an exemplary aspect of the present disclosure includes a link assembly with a roller bearing. An insert mounted to a load beam located such that the roller bearing contacts the insert.

14 Claims, 12 Drawing Sheets

U.S. PATENT DOCUMENTS

| | | | | |
|---|---|---|---|---|
| 4,765,781 | A | | 8/1988 | Wilks et al. |
| 4,988,239 | A | | 1/1991 | Firth |
| 5,094,340 | A | | 3/1992 | Avakov |
| 5,273,556 | A | | 12/1993 | McMahon et al. |
| 5,435,433 | A | | 7/1995 | Jordan et al. |
| 5,492,216 | A | | 2/1996 | McCoy et al. |
| 5,558,473 | A | | 9/1996 | Lindahl |
| 5,560,550 | A | | 10/1996 | Krawczyk |
| 5,960,938 | A | * | 10/1999 | Clopton ..... 198/867.13 |
| 6,152,668 | A | | 11/2000 | Knoch |
| 6,220,790 | B1 | | 4/2001 | Schenk et al. |
| 6,257,567 | B1 | | 7/2001 | Hansmann et al. |
| 6,296,110 | B1 | | 10/2001 | van Zijderveld et al. |
| 6,533,104 | B1 | | 3/2003 | Starlinger-Huemer et al. |
| 6,875,697 | B2 | | 4/2005 | Trivedi |
| 7,303,597 | B2 | | 12/2007 | Sprouse et al. |
| 7,387,197 | B2 | | 6/2008 | Sprouse et al. |
| 2002/0063041 | A1 | | 5/2002 | Fischer |
| 2004/0023739 | A1 | | 2/2004 | Linder |
| 2010/0320061 | A1 | | 12/2010 | Saunders |

FOREIGN PATENT DOCUMENTS

| | | |
|---|---|---|
| GB | 2002025 | 2/1979 |
| JP | 6287567 | 10/1994 |

* cited by examiner

LOAD BEAM UNIT REPLACEABLE INSERTS FOR DRY COAL EXTRUSION PUMPS

STATEMENT REGARDING FEDERALLY SPONSORED RESEARCH OR DEVELOPMENT

This disclosure was made with Government support under DE-FC26-04NT42237 awarded by The Department of Energy. The Government has certain rights in this disclosure.

BACKGROUND

The present disclosure relates to a dry coal extrusion pump for coal gasification, and more particularly to a track therefor.

The coal gasification process involves conversion of coal or other carbon-containing solids into synthesis gas. While both dry coal and water slurry are used in the gasification process, dry coal pumping may be more thermally efficient than current water slurry technology. In order to streamline the process and increase the mechanical efficiency of dry coal gasification, the use of dry coal extrusion pumps has become critical in dry coal gasification.

BRIEF DESCRIPTION OF THE DRAWINGS

Various features will become apparent to those skilled in the art from the following detailed description of the disclosed non-limiting embodiment. The drawings that accompany the detailed description can be briefly described as follows:

FIGS. 12A and 11B are views of another non-limiting embodiment of an insert arrangement.

DETAILED DESCRIPTION

Figure 1A:
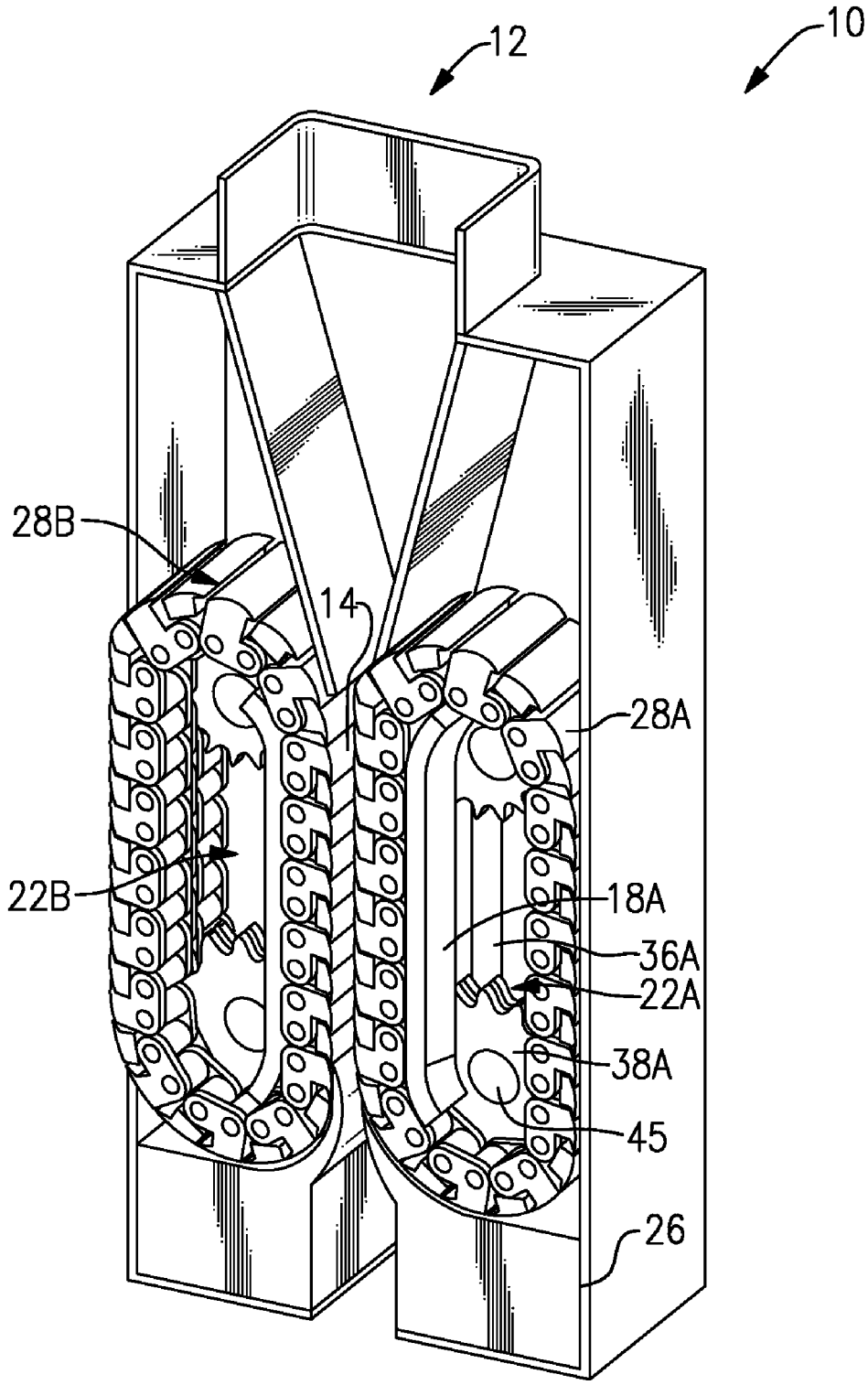
FIG. 1A is a perspective view of a dry coal extrusion pump.
Figure 1B:
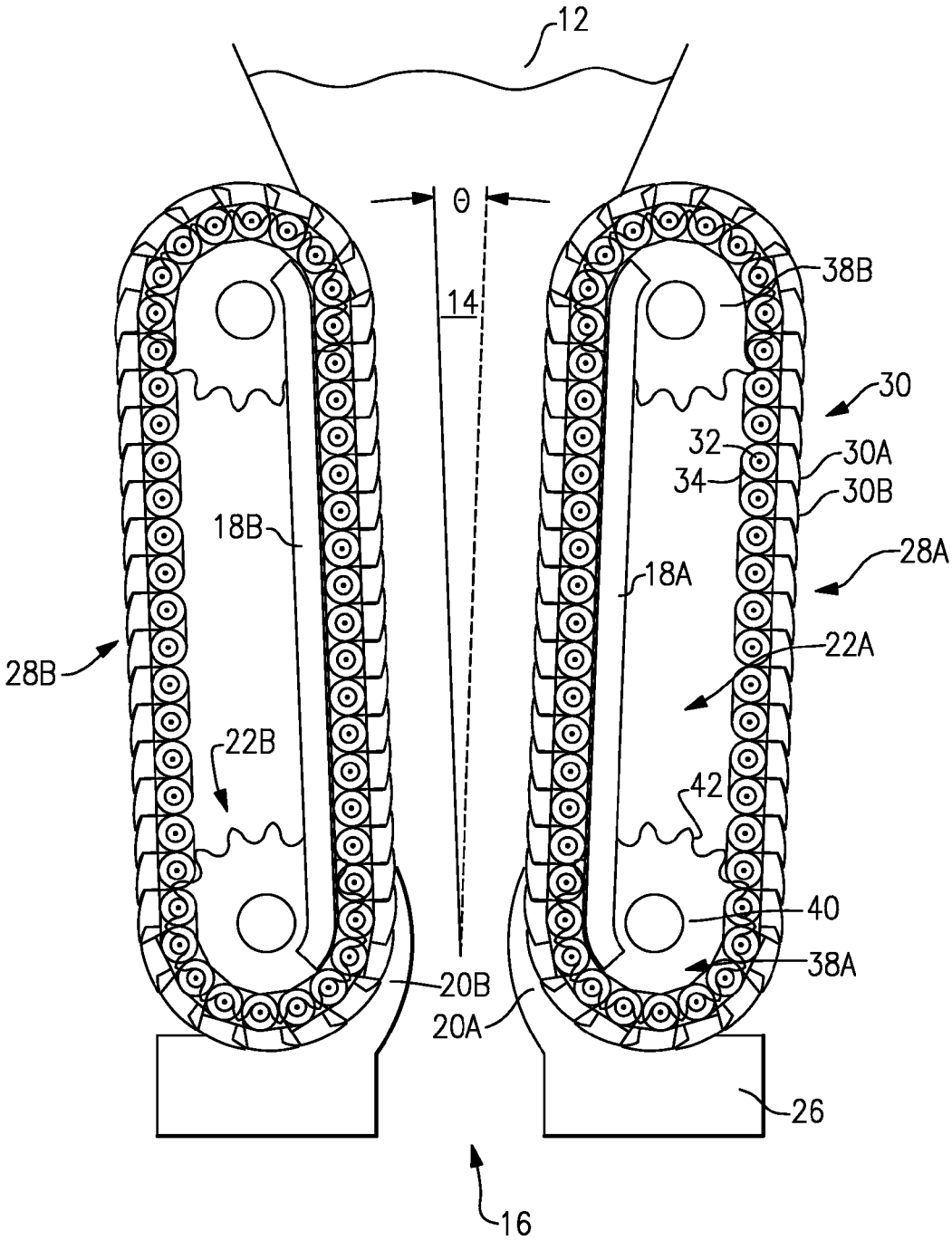
FIG. 1B is a front view of the dry coal extrusion pump.

FIGS. 1A and 1B schematically illustrate a perspective and front view, respectively, of a dry coal extrusion pump 10 for transportation of a dry particulate material such as pulverized dry coal. Although pump 10 is discussed as transporting pulverized dry coal, pump 10 may transport any dry particulate material and may be used in various industries, including, but not limited to petrochemical, electrical power, food, and agricultural. It should be understood that "dry" as utilized herein does not limit the pump 10 from use with particulate material which may include some liquid content, e.g., damp particulate materials.

The pump 10 generally includes an inlet 12, a passageway 14, an outlet 16, a first load beam 18A, a second load beam 18B, a first scraper seal 20A, a second scraper seal 20B, a first drive assembly 22A, a second drive assembly 22B, and an end wall 26. Pulverized dry coal is introduced into pump at inlet 12, communicated through passageway 14, and expelled from pump 10 at outlet 16. Passageway 14 is defined by first track assembly 28A and second track assembly 28B, which are positioned substantially parallel and opposed to each other. First track assembly 28A, together with second track assembly 28B, drives the pulverized dry coal through passageway 14.

The distance between first and second track assembly 28A, 28B, the convergence half angle .theta. between load beams 18A and 18B, and the separation distance between scraper seals 20A and 20B may be defined to achieve the highest mechanical solids pumping efficiency possible for a particular dry particulate material without incurring detrimental solids back flow and blowout inside pump 10. High mechanical solids pumping efficiencies are generally obtained when the mechanical work exerted on the solids by pump 10 is reduced to near isentropic (i.e., no solids slip) conditions.

Each load beam 18A, 18B is respectively positioned within the track assembly 28A, 28B. The load beams 18A, 18B carry the mechanical load from each track assembly 28A, 28B to maintain passageway 14 in a substantially linear form. The load beams 18A, 18B also support the respective drive assemblies 22A, 22B which power drive shaft 45 and sprocket assembly 38A to power the respective track assembly 28A, 28B. A tensioner assembly 47 may also be located within the load beams 18A, 18B to provide adjustable tension to the respective track assembly 28A, 28B.

The scraper seals 20A, 20B are positioned proximate passageway 14 and outlet 16. The track assemblies 28A, 28B and the respective scraper seals 20A, 20B form a seal between pump 10 and the outside atmosphere. Thus, the pulverized dry coal particles that become caught between track assemblies 28A, 28B and respective scraper seals 20A, 20B form a pressure seal. The exterior surface of scraper seal 20A, 20B defines a relatively small angle with respect to the straight section of the respective track assembly 28A, 28B to scrape the pulverized dry coal stream off of the moving track assembly 28A, 28B. The angle prevents pulverized dry coal stagnation that may lead to low pump mechanical efficiencies. In an exemplary embodiment, scraper seals 20A, 20B defines a 15 degree angle with the straight section of the track assemblies 28A, 28B. The scraper seals 20A, 20B may be made of any suitable material, including, but not limited to, hardened tool steel.

It should be understood that first track assembly 28A and second track assembly 28B are generally alike with the exception that first track assembly 28A is driven in a direction opposite second track assembly 28B such that only first track assembly 28A and systems associate therewith will be described in detail herein. It should be further understood that the term "track" as utilized herein operates as a chain or belt to transport dry particulate material and generate work from the interaction between the first track assembly 28A, the second track assembly 28B and the material therebetween.

First drive assembly 22A may be positioned within or adjacent (FIG. 6) to the first interior section 36A of first track assembly 28A to drive first track assembly 28A in a first direction. First drive assembly 22A includes at least one drive sprocket assembly 38A positioned at one end of first track assembly 28A. In the disclosed, non-limiting embodiment, drive sprocket assembly 38A has a pair of generally circular-shaped sprocket bases 40 with a plurality of sprocket teeth 42 which extend respectively therefrom for rotation about an axis S. The sprocket teeth 42 interact with first track assembly 28A to drive the first track assembly 28A around load beam 18A. In an exemplary embodiment, first drive assembly 22A rotates first track assembly 28A at a rate of between approximately 1 foot per second and approximately 5 feet per second (ft/s).

Figure 2:
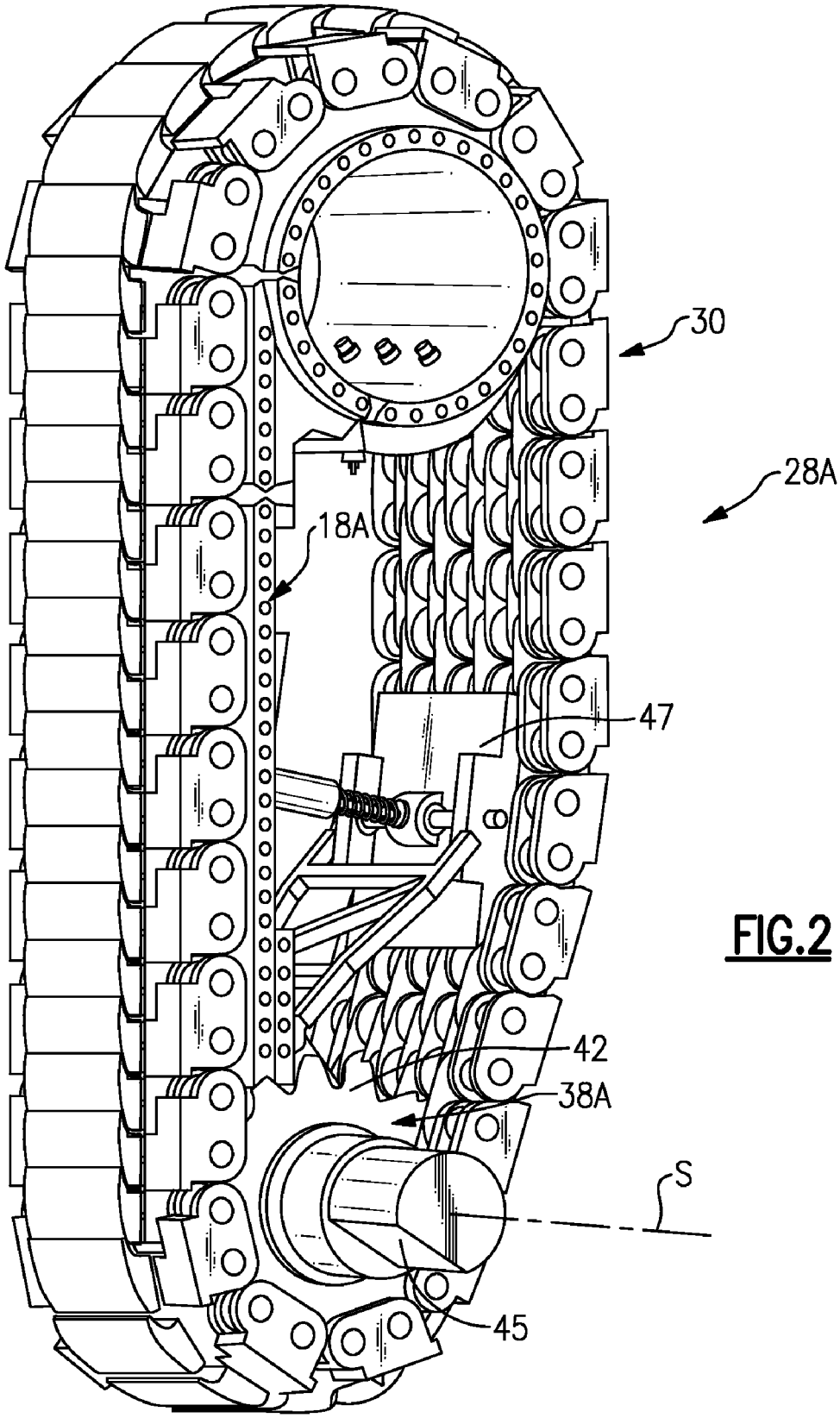
FIG. 2 is an expanded view of a track assembly for a dry coal extrusion pump.
Figure 5:
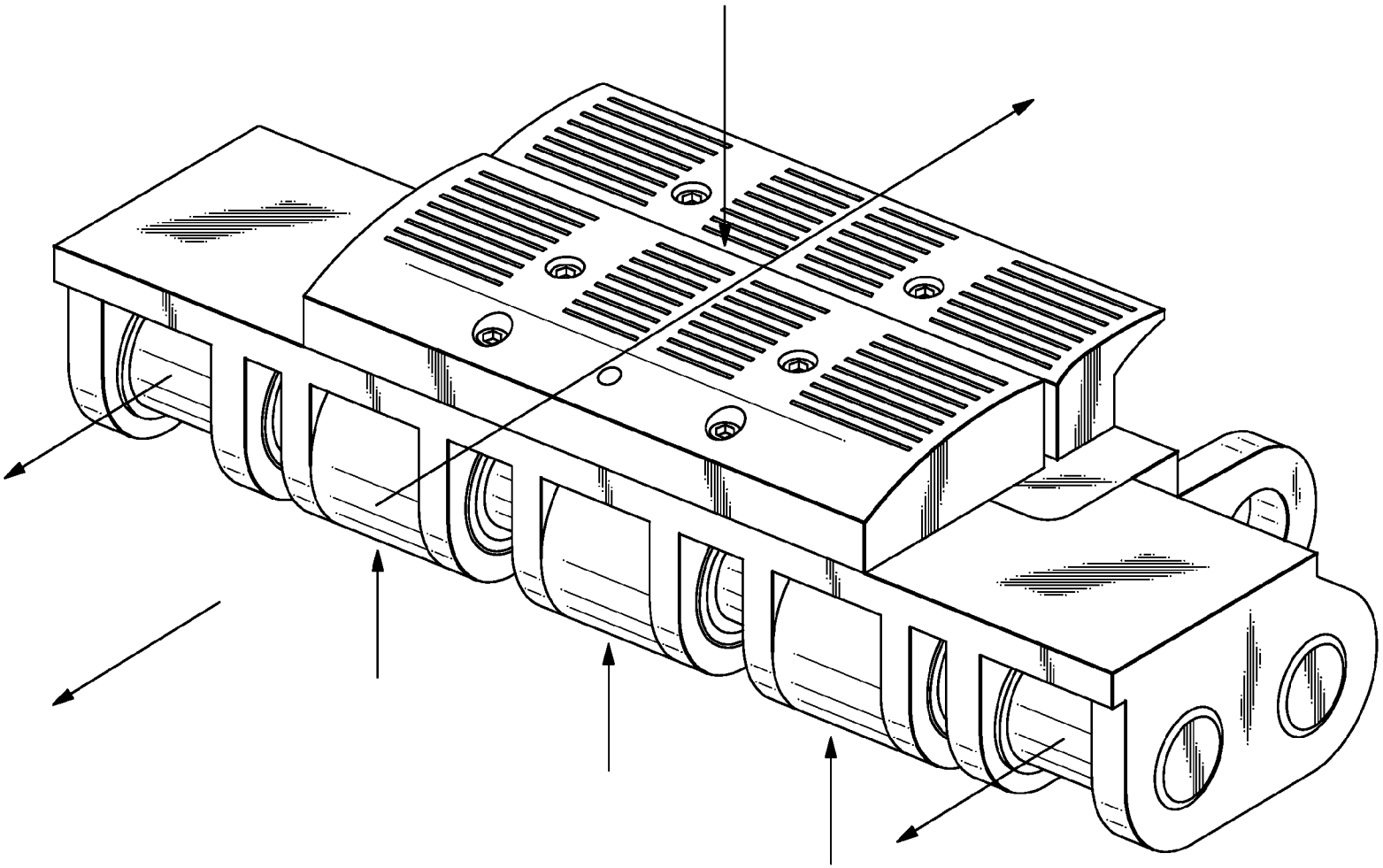
FIG. 5 is a perspective view of a link assembly illustrating stresses thereon.
Figure 6:
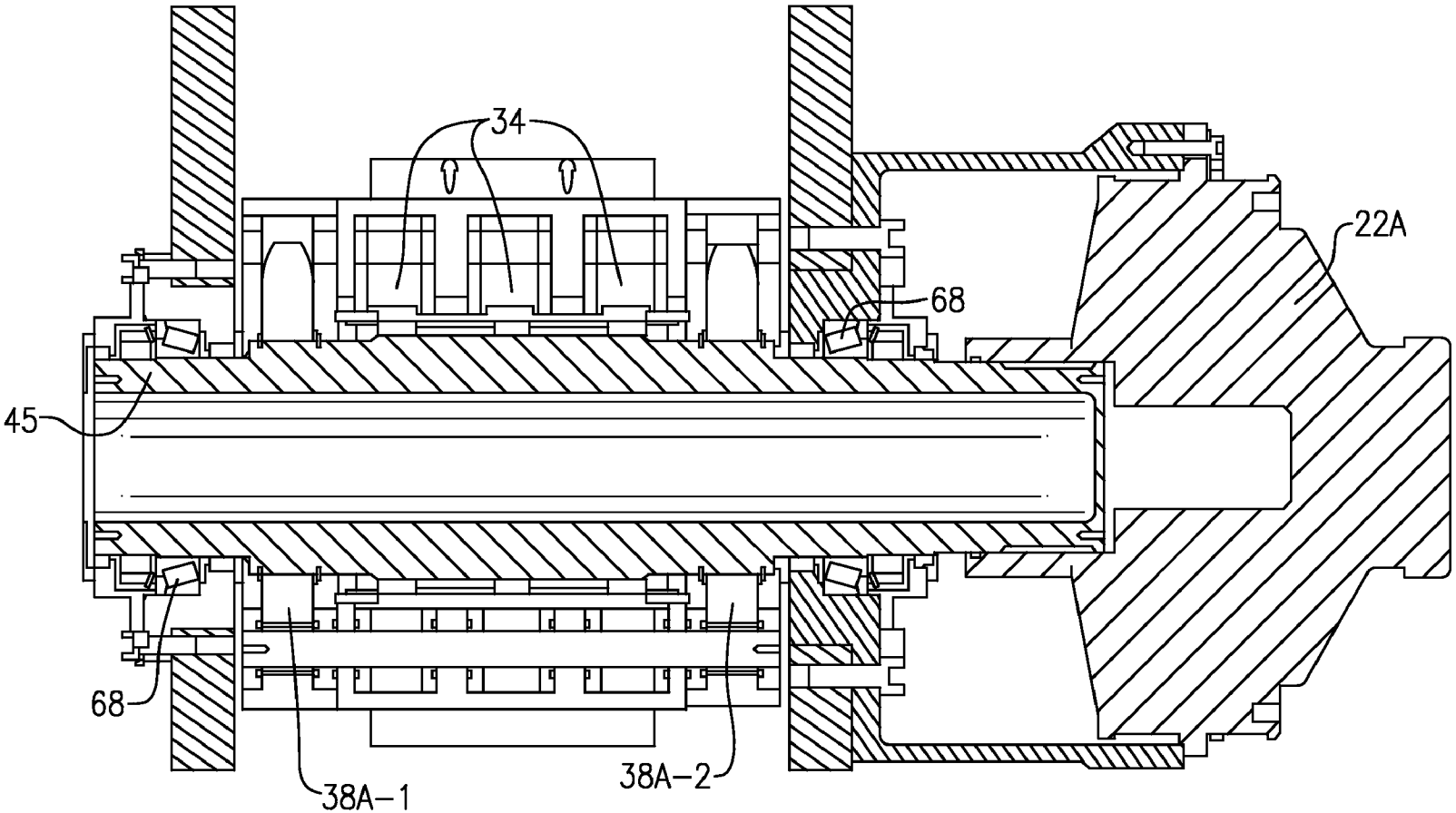
FIG. 6 is a sectional view through a drive shaft of the dry coal extrusion pump.

With reference to FIG. 2, each track assembly 28A, 28B (only track assembly 28A shown) is formed from a multiple of link assemblies 30 (one link shown in FIGS. 3 and 4) having a forward link 30A and a an aft link 30B connected in an alternating continuous series relationship by a link axle 32 which supports a plurality of track roller bearings 34. Track roller bearings 34 are mounted to the link axle 32 and function to transfer the mechanical compressive loads normal to link assembly 30 into the load beam 18A (FIGS. 5 and 6).

The pulverized dry coal being transported through passageway 14 creates solid stresses on each track assembly 28A, 28B in both a compressive outward direction away from passageway 14 as well as in a shearing upward direction toward inlet 12. The compressive outward loads are carried from link assembly 30 into link axle 32, into track roller bearings 34, and into first load beam 18A. First load beam 18A thus supports first track assembly 28A from collapsing into first interior section 36A of the first track assembly 28A as the dry pulverized coal is transported through passageway 14. The shearing upward loads are transferred from link assembly 30 directly into drive sprocket 38A and drive assembly 22A (FIG. 6).

Figure 3:
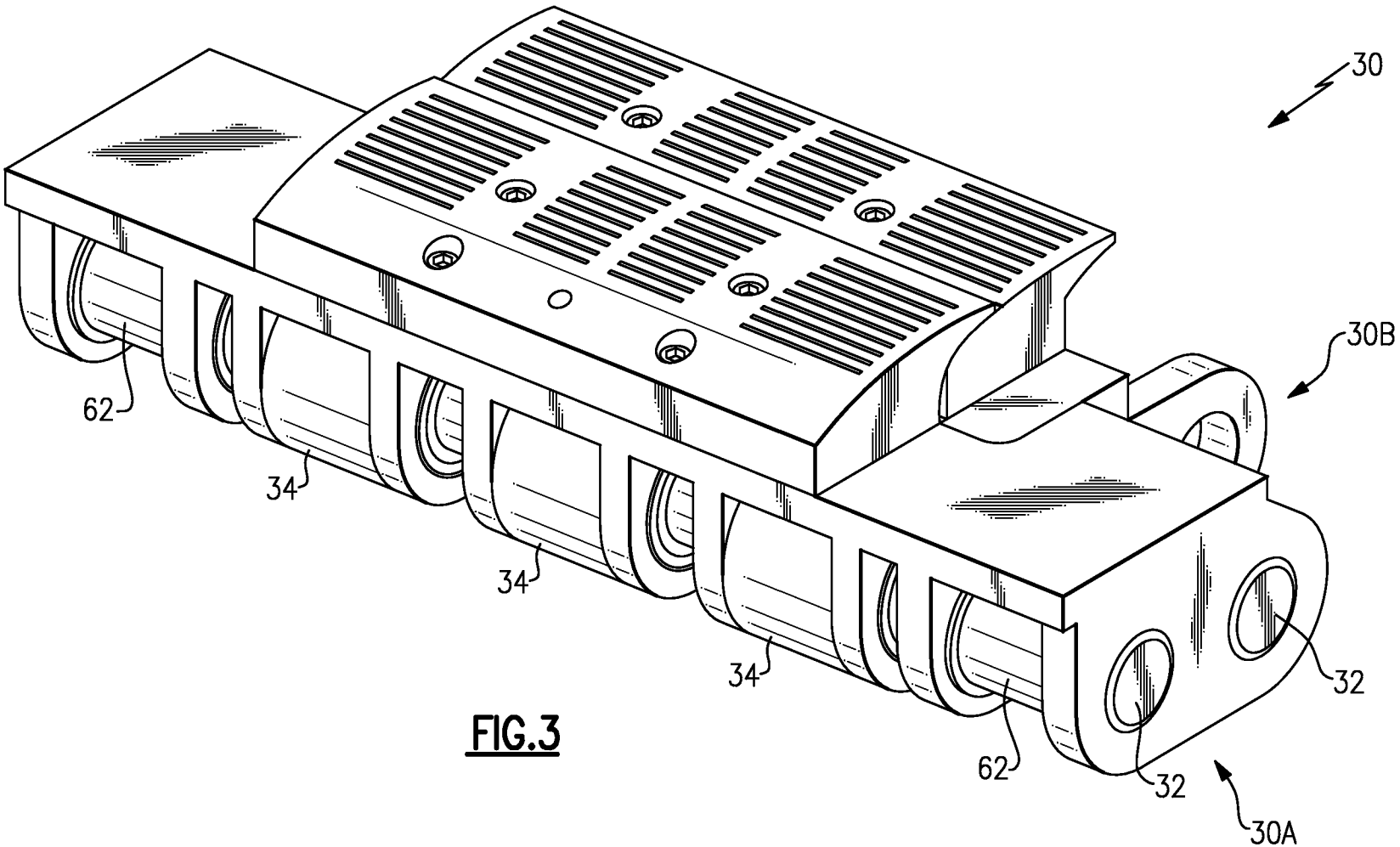
FIG. 3 is a perspective view of a link assembly.
Figure 4:
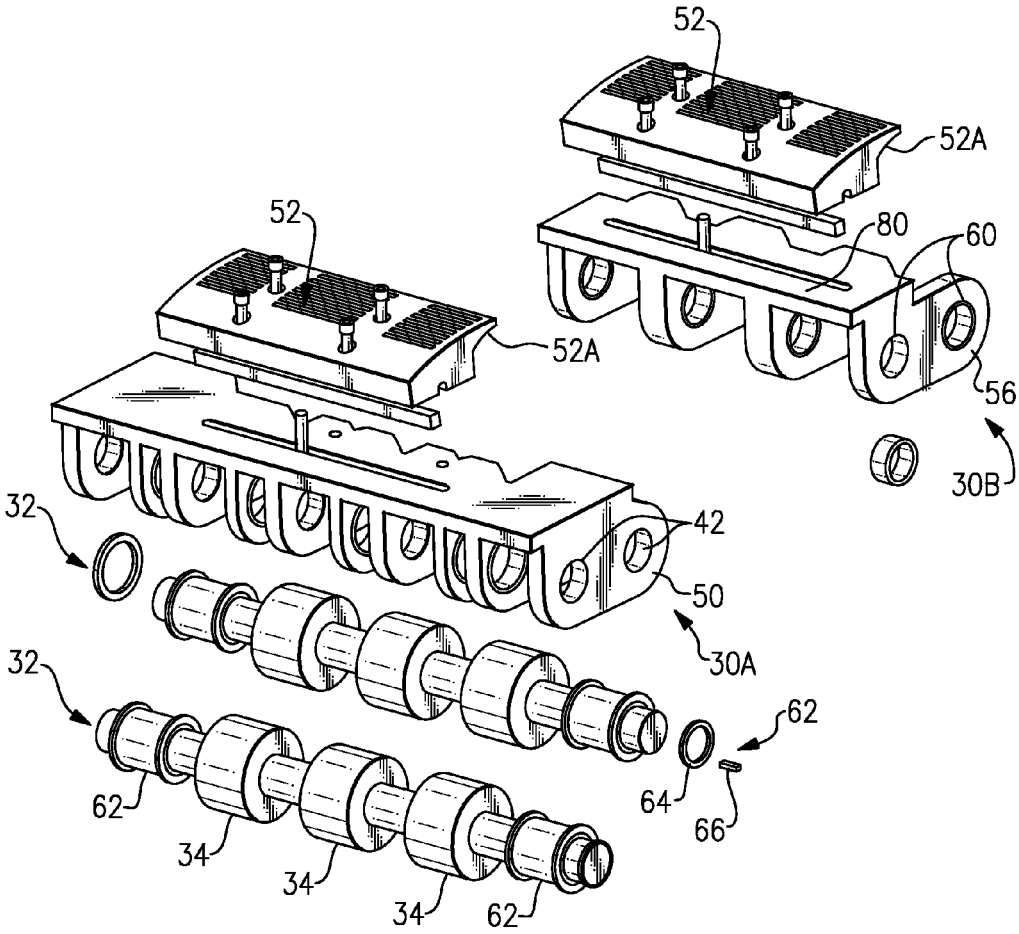
FIG. 4 is an exploded view of the link assembly of FIG. 3.

Referring to FIGS. 3 and 4, each link assembly 30 provides for a relatively flat surface to define passageway 14 as well as the flexibility to turn around the drive sprocket 38A and the load beam 18A. The plurality of forward links 30A and the plurality of aft links 30B are connected by the link axles 32. The link axles 32 provide for engagement with the sprocket teeth 42. Link assembly 30 and link axles 32 may be manufactured of any suitable material, including, but not limited to, hardened tool steel. Each forward link 30A is located adjacent to an aft link 30B in an alternating arrangement.

Each forward link 30A generally includes a forward box link body 50 and a replaceable link tile 52 with an overlapping link ledge 52A. The forward box link body 50 includes a multiple of apertures 54 to receive the link axle 32 to attach each respective forward link 30A to an adjacent aft link 30B. Each aft link 30B generally includes a bushing link body 56 and a replaceable link tile 52 with an overlapping link ledge 52A. The bushing link body 56 includes a multiple of apertures 60 to receive the link axle 32 to attach each respective forward link 30A to an adjacent aft link 30B.

Each overlapping link ledge 52A at least partially overlaps the adjacent aft link tile 52 to define a continuous surface. An effective seal is thereby provided along the passageway 14 by the geometry of adjacent link tiles 52 to facilitate transport of the dry particulate material with minimal injection thereof into the link assembly 30. The term "tile" as utilized herein defines the section of each link which provides a primary working surface for the passageway 14. The term "ledge" as utilized herein defines the section of each link tile 52 which at least partially overlaps the adjacent tile 52. It should be understood that the ledge may be of various forms and alternatively or additionally extend from the leading edge section and/or the trailing edge section of each tile 52.

Each link axle 32 supports the plurality of track roller bearings 34 and an end sprocket bushing retainer 62 upon which sprocket load is transferred. A retainer ring 64 and key 66 retains the link axle 32 within the links 30A, 30B. In this non-limiting embodiment, the sprocket assembly 38A includes a pair of sprockets 38A-1, 38A-2 mounted in a generally outboard position relative to the link axle 32 within the links 30A, 30B (FIG. 6).

With reference to FIG. 6, each drive shaft 45 is supported upon a set of tapered roller bearing assemblies 68 to react shear and normal radial loads as well as react axial loads in an upset condition. The plurality of track roller bearings 34 transfer a normal load to the load beams 18A, 18B to carry the mechanical load from each track assembly 28A, 28B.

Figure 7:
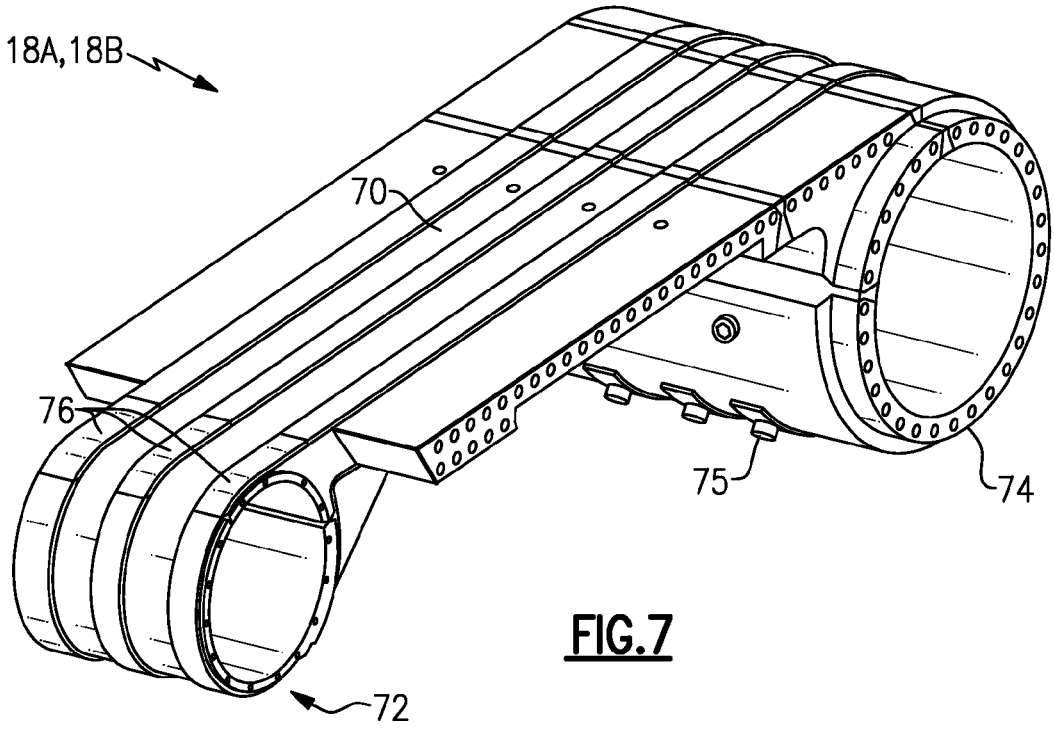
FIG. 7 is a perspective view of a load beam of the dry coal extrusion pump.
Figure 9:
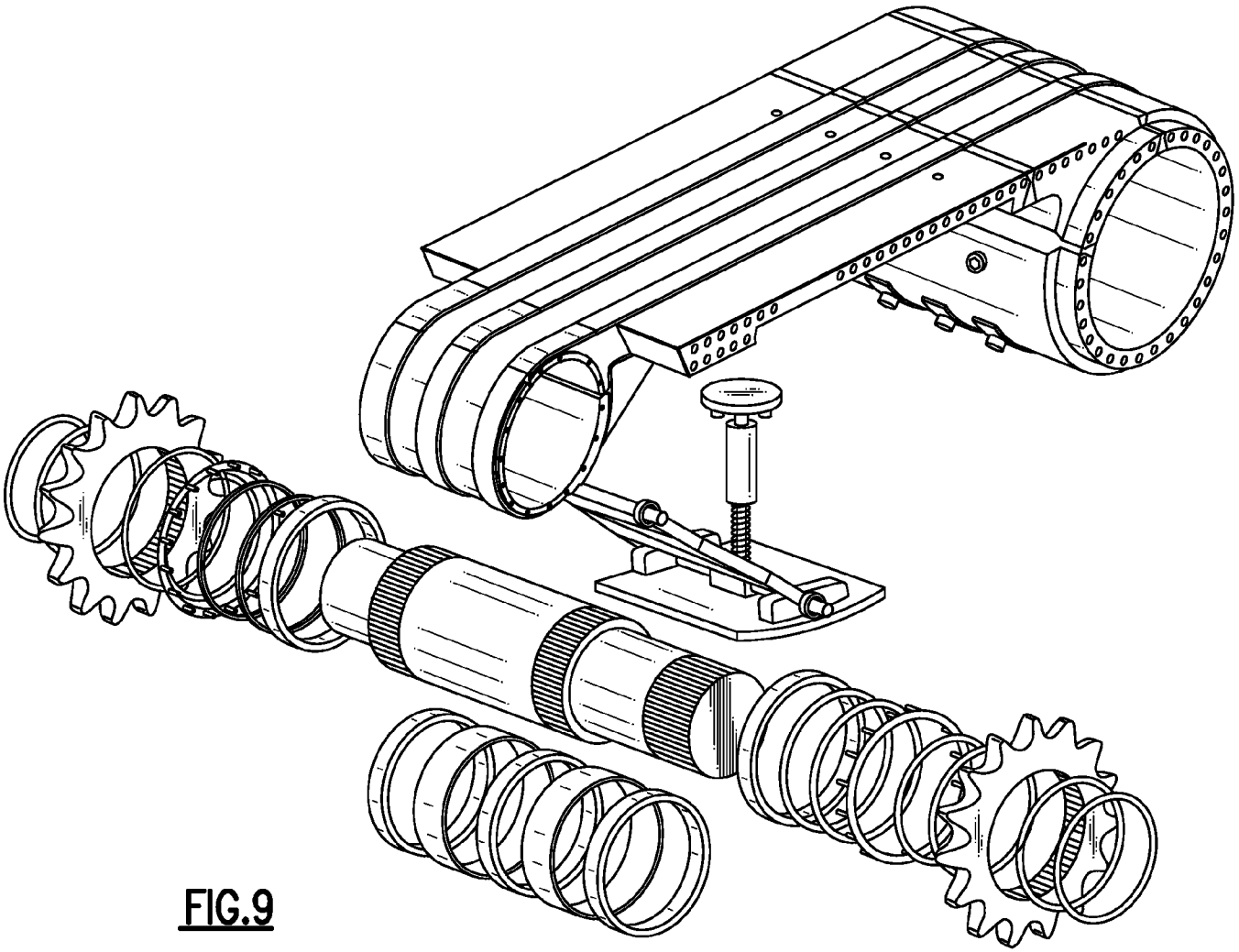
FIG. 9 is an exploded view of the load beam supported components.

With reference to FIG. 7, each load beam 18A, 18B generally includes a generally planar surface 70 between a first cylindrical member 72 and a second cylindrical member 74 to define passageway 14. The first cylindrical member 72 may be relatively shorter and smaller in diameter than the second cylindrical member 74 to allow clearance for the associated sprocket assembly 38A, 38B. The second cylindrical member 74 is essentially an idler over which the track assembly 28A is guided. The load beams 18A may be integrally formed and provide mounts 75 for sensors or other systems (FIG. 9).

Figure 8:
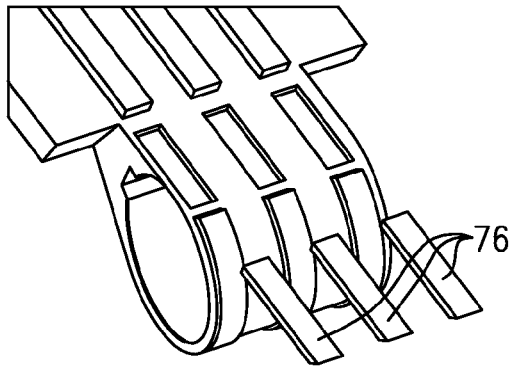
FIG. 8 is an exploded view of the load beam and inserts therefor.

Adjacent to the first cylindrical member 72 at the transition to the generally planar surface 70, each load beam 18A, 18B includes inserts 76 which correspond to the position of each of the plurality of track roller bearings 34 (FIG. 8). The inserts 76 resist high track roller bearing 34 contact stresses and in one non-limiting embodiment may be manufactured of a 52100 steel alloy. It should be understood that alternative or additionally positions may include inserts 76.

Figure 10A:
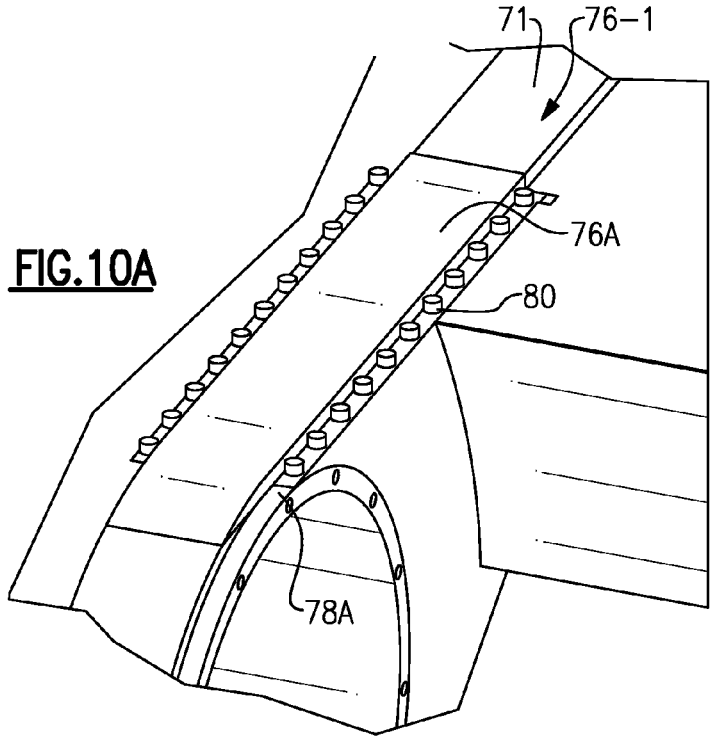
FIGS. 10A-10C are views of one non-limiting embodiment of an insert arrangement.
Figures 10B, 11B, 12B:
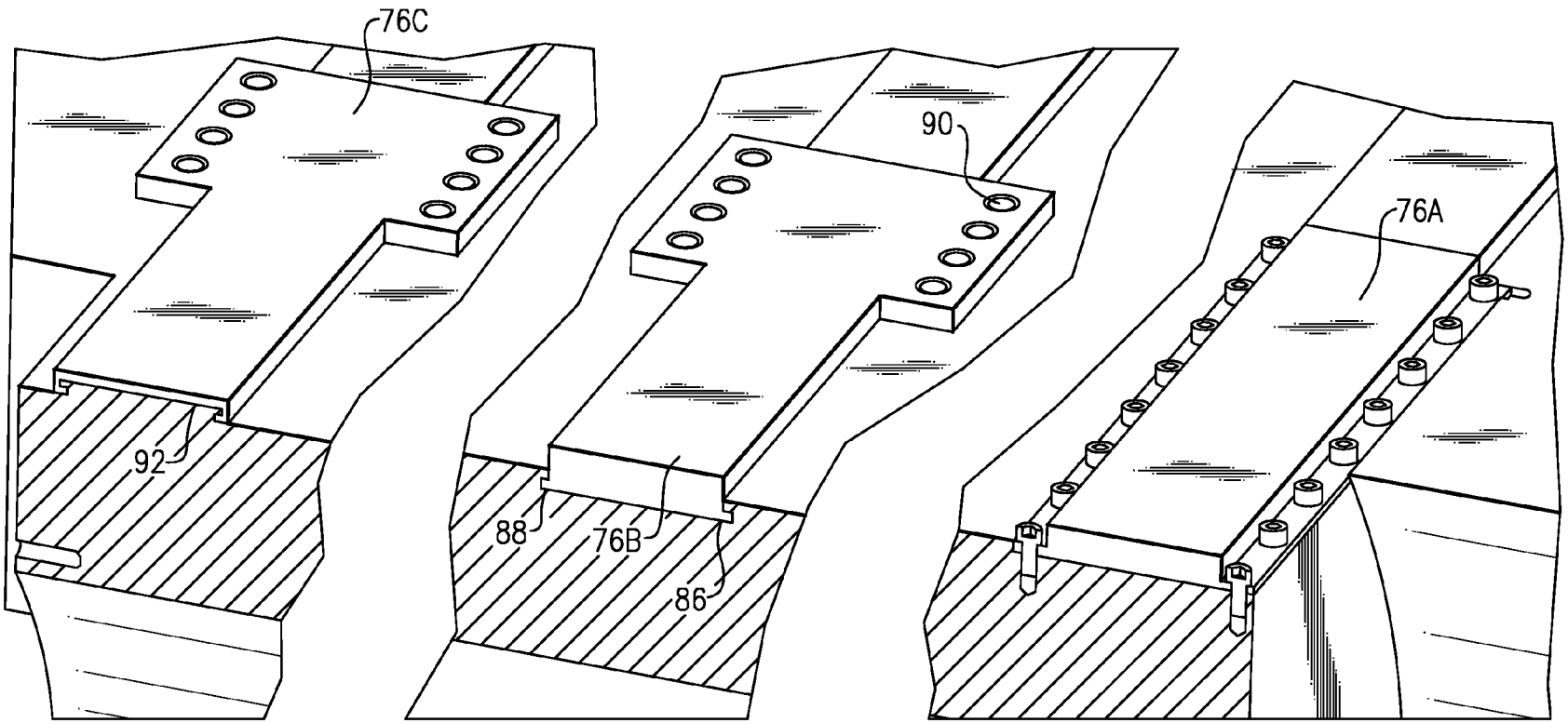
Figure 10C:
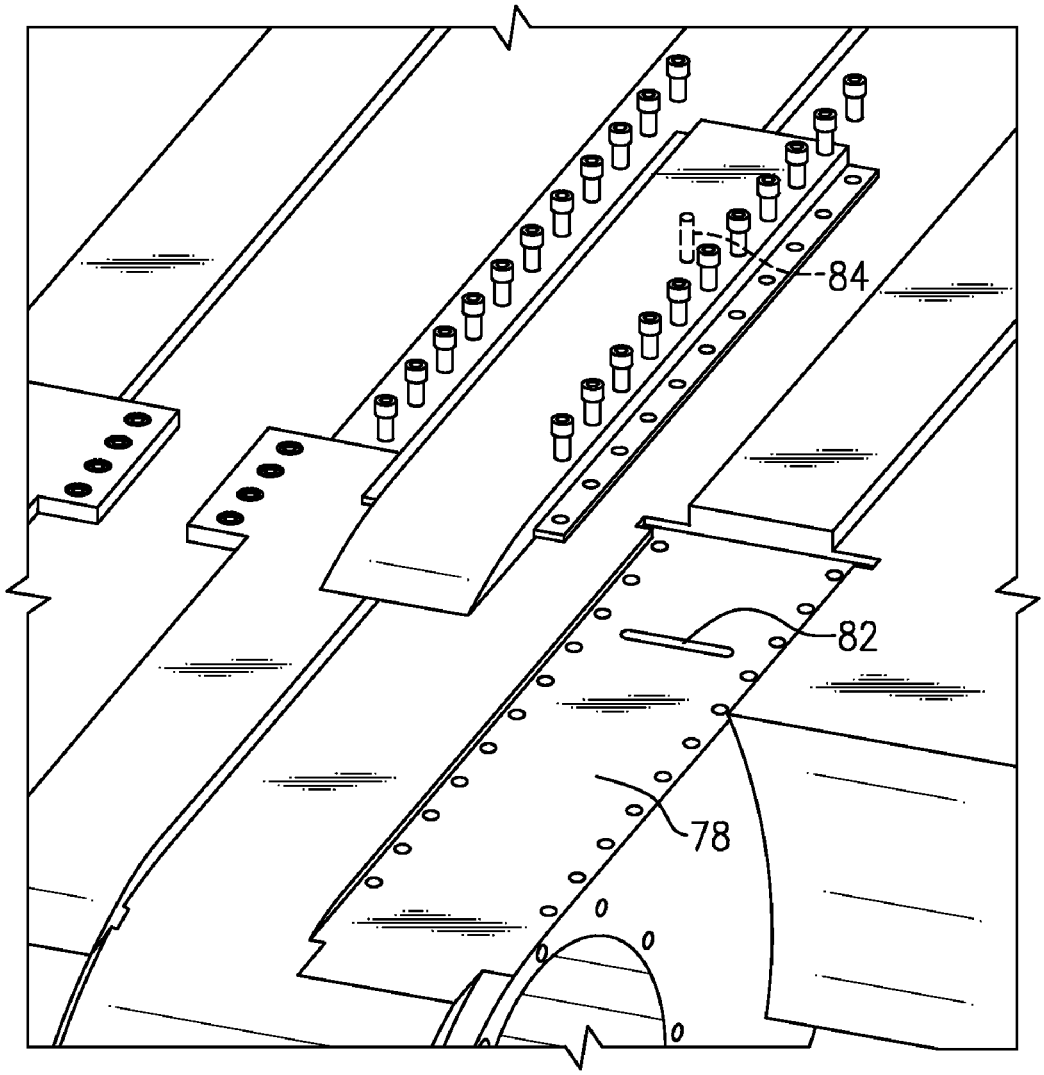

With reference to FIGS. 10A-10C, one non-limiting embodiment of the insert 76-1 may be a pocket design in which the insert 76A fits within a milled pocket 78A and retained with a multiple of fasteners 80. The inserts are essentially extensions of rails 71 formed integral with the load beam 18A, 18B. That is, the rails 71 extend from planar surface 70 to provide a low friction surface for roller bearings 34. The fasteners 80 may extend for a significant length of the insert 76A. A slot 82 may be formed within the pocket 78A to receive a key 84 which extends from the insert 76A.

Figure 11A:
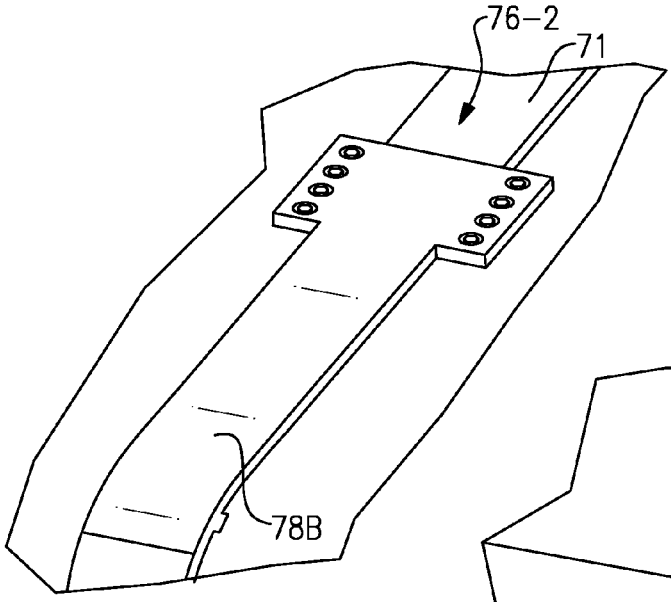
FIGS. 11A and 11B are views of another non-limiting embodiment of an insert arrangement.

With reference to FIGS. 11A-11B, another non-limiting embodiment of the insert 76-2 may be a pocket design in which the insert 76B includes a "T" slot pocket 86 milled into the load beam 18A, 18B to receive a male shaped "T" geometry 88 formed by the insert 76B. The insert 76B may be retained with a multiple of fasteners 90. The fasteners 90 may extend for only a relatively short length of the insert 76B as the "T" geometry retains the length of the insert 76B.

Figure 12A:
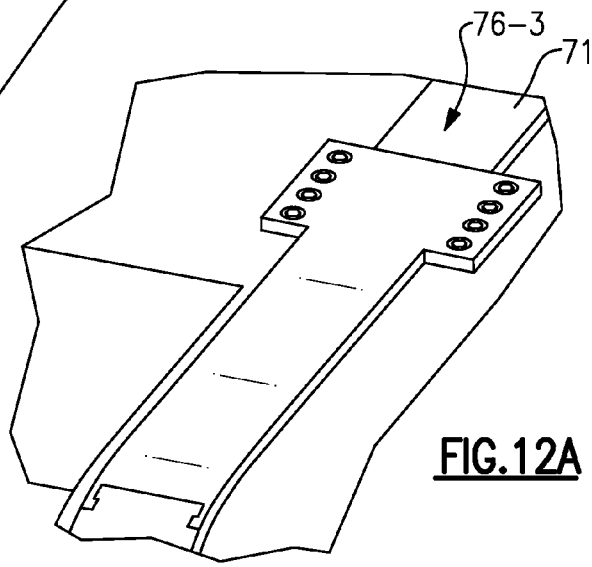

With reference to FIGS. 12A-12B, another non-limiting embodiment of the insert 76C may also be a pocket design in which the insert 76C includes a slot 92 and the "T" geometry extends from a surface of the load beam 18A, 18B in a manner generally opposite that of FIGS. 11A-11B.

It should be understood that various alternative or additional insert 76 retention features may be provided. The inserts 76 provide the ability to carry high rolling loads without damage to the load beam material substrate, allow replacement of potential wear items without replacing major components; permit a specific match between the rolling elements without having to address a monolithic item; minimize the remote likelihood of failure; and provides for flexibility to the size and location of load bearing components.

It should be understood that relative positional terms such as "forward," "aft," "upper," "lower," "above," "below," and the like are with reference to the normal operational attitude of the machine and should not be considered otherwise limiting.

It should be understood that like reference numerals identify corresponding or similar elements throughout the several drawings. It should also be understood that although a particular component arrangement is disclosed in the illustrated embodiment, other arrangements will benefit herefrom.

Although particular step sequences are shown, described, and claimed, it should be understood that steps may be performed in any order, separated or combined unless otherwise indicated and will still benefit from the present disclosure.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be understood that within the scope of the appended claims, the disclosure may be practiced other than as specifically described. For that reason the appended claims should be studied to determine true scope and content.

What is claimed is:

1. A track assembly for a particulate material extrusion pump comprising:

a link assembly having a plurality of track roller bearings;

a load beam having a planar portion and a cylindrical portion, the planar portion including a planar surface and a plurality of rails projecting outwardly from the planar surface and running parallel to each other along the planar surface;

a plurality of pockets arranged, respectively, at ends of the plurality of rails proximate a transition between the planar and cylindrical portions; and a plurality of inserts mounted, respectively, in the plurality of pockets and aligned to continue the plurality of rails, wherein the link assembly is configured such that the plurality of track roller bearings contact the plurality of rails and the plurality of inserts.

2. The track assembly as recited in claim 1, wherein said link assembly comprises:

a plurality of forward links in which each of said plurality of forward links are connected to a respective aft link with a link axle which supports said plurality of roller bearings.

3. The track assembly as recited in claim 1, wherein said link assembly comprises:

a plurality of forward links, each of said plurality of forward links having a forward link body with an overlapping forward link ledge; and a plurality of aft links, each of said plurality of aft links having an aft link body with an overlapping aft link ledge, each overlapping forward link ledge at least partially overlaps an adjacent aft link body and each overlapping aft link ledge at least partially overlaps an adjacent forward link body.

4. The track assembly as recited in claim 1, wherein said planar surface extends between a first cylindrical member and a second cylindrical member.

5. The track assembly as recited in claim 4, wherein said first cylindrical member is relatively shorter than said second cylindrical member.

6. The track assembly as recited in claim 1, wherein each of said pockets provides a "T" shaped interface.

7. The track assembly as recited in claim 1, wherein each of said pockets includes a slot within which a key of said insert fits.

8. The track assembly as recited in claim 1, wherein said planar surface extends between a first cylindrical member and a second cylindrical member, and said first cylindrical member is axially shorter than said second cylindrical member.

9. The track assembly as recited in claim 1, wherein each of said plurality of inserts includes a flange having openings there through and fasteners received through the openings to secure each of said plurality of inserts in the plurality of pockets.

10. The track assembly as recited in claim 1, wherein each of said plurality of inserts includes a planar insert portion portion extending from a corresponding one of said plurality of rails and transitioning to a curved insert end portion distal from said corresponding one of said plurality of rails.

11. A load beam for a particulate material extrusion pump comprising:

a load beam having a planar portion and a cylindrical portion, the planar portion including a planar surface and a plurality of rails projecting outwardly from the planar surface and running parallel to each other along the planar surface;

a plurality of pockets arranged, respectively, at ends of the plurality of rails proximate a transition between the planar and cylindrical portions; and a plurality of inserts mounted, respectively, in the plurality of pockets and aligned to continue the plurality of rails.

12. The load beam as recited in claim 11, wherein each of said pockets provides a "T" shaped interface.

13. The load beam as recited in claim 11, wherein each of said pockets includes a slot within which a key of said insert fits.

14. A pump for transporting particulate material comprising:

a passageway defined in part by a track assembly, said track assembly includes a link assembly with a roller bearing;

a drive assembly including a sprocket assembly operable to power the link assembly;

a load beam having a planar portion and a cylindrical portion;

an insert mounted to the load beam proximate a transition between the planar and cylindrical portions, wherein the track assembly is configured such that the track roller bearings contact the insert; and a scraper seal positioned proximate the passageway and an outlet.

* * * * *